United States Patent [19]

Bak et al.

[11] Patent Number: 4,527,608

[45] Date of Patent: Jul. 9, 1985

[54] METHOD FOR INOCULATING LIQUID METAL CAST UNDER LOW PRESSURE

[75] Inventors: Claude Bak; Rio Bellocci, both of Pont a Mousson; Serge Colmet, Fumel, all of France

[73] Assignee: Pont-A-Mousson S.A., Nancy, France

[21] Appl. No.: 613,117

[22] Filed: May 23, 1984

[30] Foreign Application Priority Data

May 30, 1983 [FR] France ..... 83 08942

[51] Int. Cl.[3] ..... B22D 27/20; B22D 27/14

[52] U.S. Cl. ..... 164/58.1; 164/119; 164/306

[58] Field of Search ..... 164/55.1, 56.1, 57.1, 164/58.1, 119, 306, 309

[56] References Cited

U.S. PATENT DOCUMENTS 3,842,893 10/1974 Booth ..... 164/119 X 3,991,810 11/1976 Nieman ..... 164/57.1

*Primary Examiner*—Nicholas P. Godici

*Assistant Examiner*—Kenneth F. Berg

*Attorney, Agent, or Firm*—Sughrue, Mion, Zinn, Macpeak and Seas

[57] ABSTRACT

Liquid metal M in a casting ladle 1 located under a mold A is cast uphill under low pressure into the mold cavity 10 through a vertical shaft 3. The metal is treated by a soluble inoculation wire 13 suspended down through the cavity over a length L greater than the height h of the mold with its lower part H submerged in the liquid metal filling the shaft. The ladle pressure is maintained until the wire is fully dissolved, and then raised to fill the mold cavity with the inoculated liquid metal.

7 Claims, 22 Drawing Figures

PRIOR ART Fig. 21
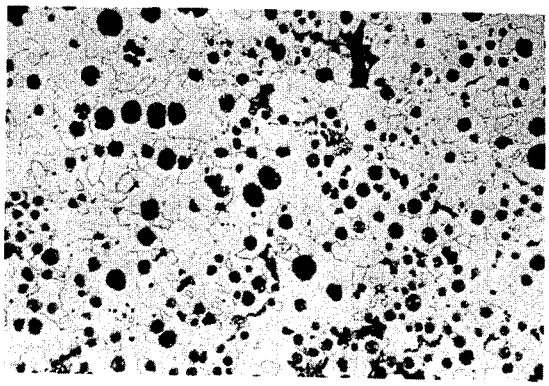
Fig. 22
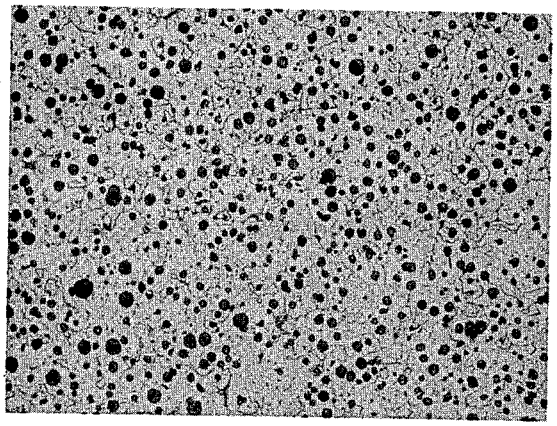

METHOD FOR INOCULATING LIQUID METAL CAST UNDER LOW PRESSURE

BACKGROUND OF THE INVENTION

This invention relates to a method for inoculating liquid metal cast under low pressure.

As is known, inoculation of a laminated, spheroidal or vermicular graphite casting can be achieved using an inoculant such as ferrosilicon powder put into a mold beforehand, where the liquid casting metal is forced into a mold uphill by a relatively low gas pressure on the order of 0.2 to 1.5 bar.

It has generally been known for some time that the purpose of inoculating the casting metal using ferrosilicon or other graphitizing products is to promote graphitization, or the formation of free graphite during the solidification of the casting in order to obtain a good resilience of the cast product. This inoculation is more effective the closer it is done to the mold, just before the casting metal enters the mold. The effect of inoculating the liquid casting is short lived, and tends to decline after a few minutes. This makes it necessary to avoid too long a delay between the inoculation and charging the mold with the liquid metal.

There is also another conventional inoculation procedure using an endless wire inoculant. The wire is easy to handle mechanically by being unwound from a spool, ensures a precise dosage of the inoculant material, and easily melts in the liquid casting metal.

French Pat. No. 2,276,124 discloses a procedure for adding a reactive metal as an elongated element suspended inside a mold, which is filled with the liquid metal to be treated. When the level of the liquid metal rises in the mold, the extended reactive element melts in the molten metal, thus releasing the reactive metal in the molten mass. The mold is gravity-fed with liquid metal. Casting is thus downhill. No problem arises in suspending the extended reactive element inside the mold. This is done manually, and the inoculation takes place inside the mold.

French Pat. No. 2,278,432 involves the use of an inoculant in the form of an endless wire unrolled from a spool, to be introduced in vertical suspension into a basin provided in the mold. This basin is located in the path of the liquid metal being treated, such path going through a runner between the vertical casting gate and the casting hollow or mold. Due to the speed at which the liquid metal goes through this intermediate inoculation basin, in which the lower end of the inoculant wire is suspended, it is difficult to achieve a good homogeneity of liquid metal inoculation, and thus of the metal mass admitted into the mold. This risk of insufficient uniformity of inoculation is greater when the casting impression is larger or more complex, notably when casting thin pieces. In fact, the solidification of the liquid metal is so fast that it is completed before the inoculant wire can completely dissolve in the liquid metal, making the inoculation incomplete and nonuniform.

The document Giesserei-Praxis No. 3 of Feb. 10, 1982, pages 29–36, explains another technique for inoculating the casting by means of a wire unrolled from a spool. The wire is introduced into the center line of the gravity gate coming from a pouring basin or a stopper rod casting-ladle. Better inoculation uniformity results because the liquid metal remains in contact with the inoculant wire over a certain length of it, just before introduction in the mold's vertical gate.

These three conventional examples involve a vertical, gravity fed cast gate, however, rather than a vertical, uphill cast gate under low pressure to charge a mold.

There is thus a problem in inoculating by means of a wire in the technique of uphill casting of the pig under low pressure, since the entry of the mold for the liquid casting, which should also be the entry of the wire, is not accessible. Indeed, it is placed in close contact with an upper nozzle of a liquid casting ascent shaft or an uphill casting tube coming from the pressurized casting ladle. The entrance of the mold is thus inaccessible to an inoculation wire being unwound. This problem exists both for molds with risers (casting hollow connected with the atmosphere by shafts) and for closed molds (casting hollow without risers, thus without a connection with the atmosphere). Moreover, the technique of low pressure uphill casting does not include risers or a basin upstream from the casting hollow for receiving an inoculant material.

SUMMARY OF THE INVENTION

The present invention solves this problem of inoculation using a wire in a metal or sand mold in a low pressure casting technique.

To this end, an object of the invention is to provide a method for treating a liquid metal cast under low pressure, notably for inoculating the casting, in which casting takes place under low pressure and by uphill casting in a mold which has an inner hollow, of the liquid metal in a casting ladle under gas pressure, situated under the mold, with which it is connected by an uphill casting shaft tightly connected to a hole for charging the mold with liquid metal, characterized in that the liquid metal is treated by a wire suspended across the casting hollow, over a length greater than the height of the mold measured above a casting nozzle located between the top of the shaft and the mold's entry hole, such that the lower part of the wire, located below the mold and outside it, is submerged into the liquid metal being treated to a predetermined length in the axis of the shaft, in which:

(a) in a phase preceding the casting, the lower end of the wire is placed just above the level of the liquid metal in the shaft;

(b) in the next phase, the gas pressure is raised in the casting ladle to make the level of the liquid metal rise to the height of the mold charging hole;

(c) the casting pressure and level are maintained during the time required to treat the liquid metal; and (d) the pressure in the casting ladle is raised to a level above the preceding one in order to make the liquid metal rise in the casting hollow or impression to fill it.

The invention is applicable both to pig iron and its inoculation and to other metals and alloys as indicated below, along with other treatments besides inoculation, such as deoxidization.

An apparatus for implementing this method includes a casting ladle for a liquid metal under low gas pressure, a mold forming an interior casting impression located above the ladle and connecting with it by an uphill casting shaft, with a casting nozzle tightly situated between a lower charging hole of the mold and the upper end of the shaft, characterized in that the upper part of the mold has a passage following the vertical axis of the uphill casting shaft, adapted to receive the liquid metal treatment wire and opening into the casting impression.

The wire is fed from a spool on which it is wound through the hole in the upper part of the mold and through the lower part of the mold such that the lower end of the wire extends beyond the lower face of the mold. Air tightness in the annular space between the passage hole and the wire is optional.

With this method and apparatus, and especially in the case of inoculating pig iron using an inoculant wire, conditions of uniform inoculation and rapid introduction of the casting into the mold after inoculation are completely satisfied in a low pressure casting technique. Indeed, the inoculation phase lasts only a few seconds before the rapid introduction of the casting into the mold, yet lasts long enough for complete fusion of the submerged wire so that the pig going into the mold is completely inoculated. Moreover, the inoculation time can be varied at will.

It is not the part of the wire crossing the casting impression that is used for the inoculation, but the part outside of and below the mold's lower face which is used.

In sum, according to the conventional technique the inoculation in the mold depends on the mold's charging system and the delivery rate of the liquid metal being inoculated, and it occurs at the same time as the liquid metal is filling the mold by gravity. The result is an inoculation that is frequently incomplete and nonuniform, without the time to be fully accomplished.

The present invention, on the other hand, provides a time (inoculation phase) for dissolution of the inoculant in the liquid metal and a time (charging phase) for the mold to be filled with the inoculated metal, and these two times, rapidly succeeding each other, are independent of each other and of easily controlled duration.

BRIEF DESCRIPTION OF THE DRAWINGS

FIGS. 21 and 22 are 10× magnification micrographs of spheroidal graphite casting pieces inoculated in low pressure castings according to the prior art and the invention, respectively.

DETAILED DESCRIPTION OF THE PREFERRED EMBODIMENTS

Figure 1:
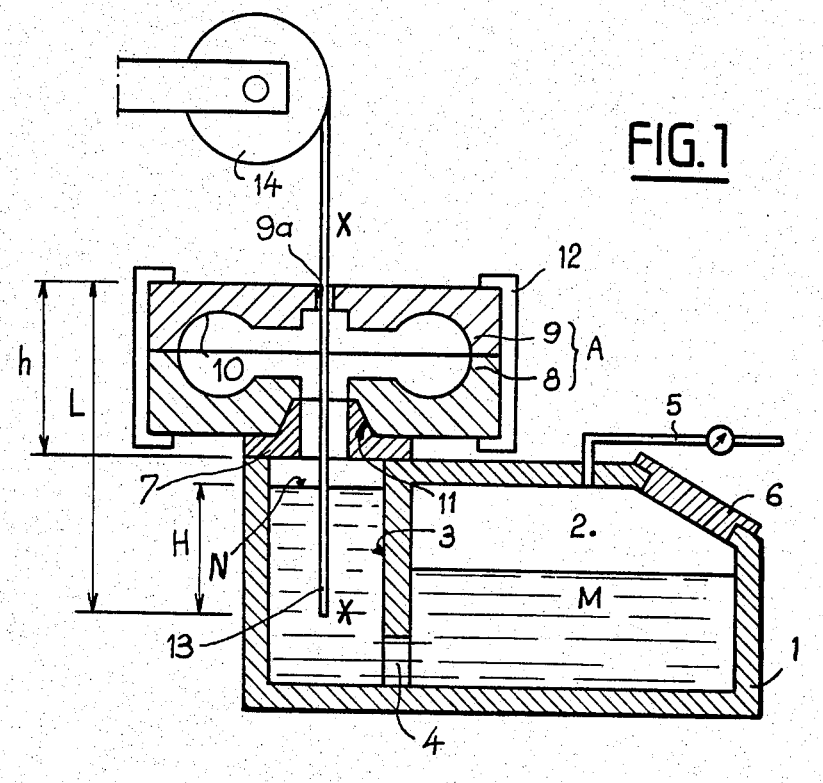
FIG. 1 is a partial, diagrammatic sectional view of an apparatus according to the invention.

Referring to FIG. 1, the apparatus for founding or low pressure casting provided by the invention includes a casting ladle 1 under gas pressure, and a closed mold A applied to the casting nozzle of the ladle. The ladle is of the teapot type, for example, and includes a chamber 2 almost completely closed and a casting shaft 3 connected with chamber 2 by hole 4 at the bottom of the ladle. The liquid metal M in the ladle chamber 2 and shaft 3 at the same time is pressurized by gas conduit 5 using air, argon or nitrogen, for example. This conduit 5 can also be connected to an outlet by a slide valve, not shown. The introduction of the liquid metal into the ladle is done through a large opening tightly sealed by cover 6.

Of course, the ladle 1 can be replaced by a ladle having an uphill casting tube going through its middle, and be equipped with a system for controlling the gas pressure and level N of liquid metal M in the uphill casting tube, as described in French Pat. No. 2,367,566.

Shaft 3 axis XX has on its upper part a truncated tip or casting nozzle 7 designed to receive the casting hole of mold A in tight contact. Mold A, for example in two parts 8 and 9 assembled along a horizontal joint, has a casting impression 10 and a truncated casting hole 11, tightly fitting over the tip 7.

As the liquid metal pressure would tend to open the casting impression 10, the two parts of the mold are kept in tight contact by conventional means, such as screw-clamps 12. The ceiling of the upper part 9 has a hole **9*a* for the passage of a metal inoculant wire 13 along axis XX of hole 11. The inoculant wire 13 is supplied from a reel or spool 14, and extends a total length L under the upper face of mold A, greater than height h of the mold measured above the base of nozzle 7**.

The length of the descending wire under the lower face of the mold is such that the length H of wire submersible in the liquid metal inside uphill casting shaft 3 corresponds to the amount of inoculant needed for the liquid metal being introduced into casting impression 10.

Figure 2:
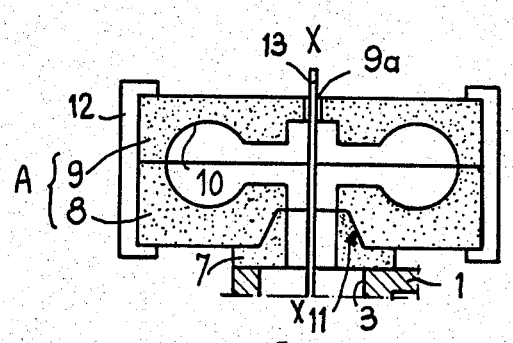
FIG. 2 is a diagrammatic sectional view of a closed sand mold to which the invention is applied.
Figure 3:
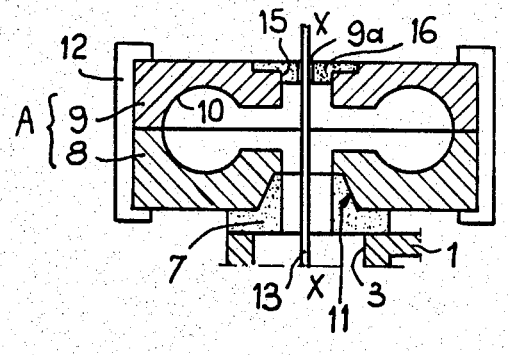
FIG. 3 is a similar view of a closed metal mold.

When mold A is sand (FIG. 2), the inoculation wire goes through a needle hole provided in the ceiling of upper part 9 corresponding to the diameter of wire 13. If mold A is metal (FIGS. 1 and 3), either its upper part has a hole **9*a* for the passage of the wire (FIG. 1) or a hole 15 stopped by a plug 16 of sand or other refractory material sintered by a binder; plug 16 itself has a passage hole 9*a* for the wire 13 (FIG. 3**).

The liquid metal M can be spheroidal or laminated graphite pig iron, steel being deoxidized or a superalloy (i.e., an austenite with over 20% iron, such as nickel and chrome or nickel, chrome and cobalt, or an alloy with less than 20% iron based on nickel or cobalt). Liquid metal M can also be aluminum or an aluminum or copper alloy.

Inoculation wire 13 is based on an inoculant product such as ferrosilicon (75%, with the remainder a steel base) for spheroidal or laminated graphite or malleable pig iron. A ferrosilicon-base inoculant wire can also be used where liquid metal M is steel. Inoculant wire 13 can be a steel wire covered with inoculants, or a lined wire (a tubular element containing the inoculant on its inside).

To treat pig iron, the wire 13 can also be magnesium, iron silicon-magnesium alloy, or titanium, and can also include, in addition to ferrosilicon, rare earths to improve the free graphite nodularisation process, promoting formation of round nodules, and bismuth, which increases the number of graphite nodules.

When the liquid metal M being treated (deoxidized) is steel or a superalloy, wire 13 can also be aluminum, silicocalcium, silicon, manganese, or rare earths.

Where the metal M is aluminum, wire 13 can be strontium or sodium.

OPERATION

Figure 4:
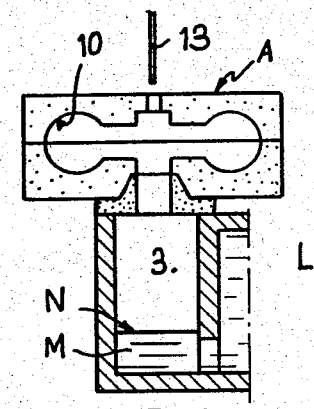
FIGS. 4, 5, 6, 7 and 8 are partial diagrammatic sectional views showing the different phases of the method for low pressure casting and inoculation according to the invention.
Figure 9:
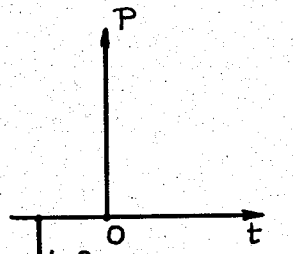
FIGS. 9, 10, 11, 12 and 13 are plots showing variations of gas pressure in the casting ladle as a function of the time and corresponding to the various phases shown in FIGS. 4, 5, 6, 7 and 8, FIGS. 14 and 15 are partial sectional views showing ways of using the inoculation wire.

The apparatus is used for inoculation and casting in the following manner, by varying the level N of the liquid casting in shaft 3 by the gas pressure in chamber 2 according to French Pat. No. 2,367,566:

(1) Before inoculation: feed wire 13 approaching mold A (FIGS. 4 and 9):

At time t-2 (FIG. 9), chamber 2 of casting ladle 1 is not pressurized; level N of the pig M in shaft 3 is low. Wire 13 is brought to mold A using a reeling machine.

Figure 5:
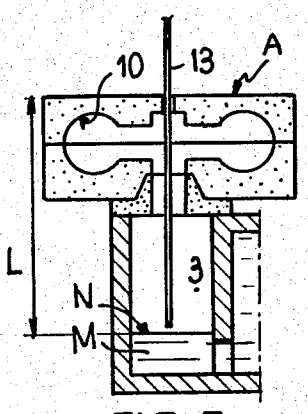
Figure 10:
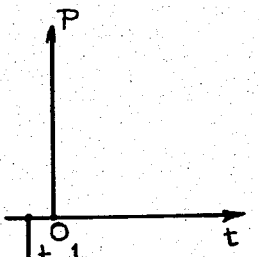

(2) Before inoculation: placement of inoculation wire 13 (FIGS. 5 and 10):

At time t-1 (FIG. 10), chamber 2 is still not pressurized. Level N stays the same, but wire 13 extends through mold A along axis XX of shaft 3, and is suspended over a length corresponding to the amount of wire to be used for the inoculation. The lower end of the wire is close to level N, just above it.

Figure 6:
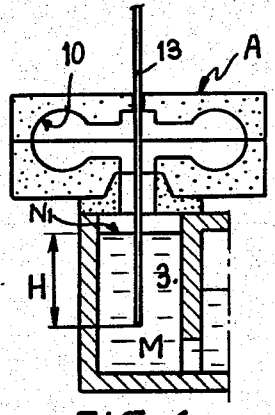

(3) Inoculation phase under pre-pressure PO (FIGS. 6 and 11):

Mold A is in place over casting nozzle 7 of shaft 3, as shown in FIG. 1. A gas pressure is introduced above liquid pig M to a PO level called "pre-pressure" which causes the pig to rise in shaft 3 to level $N_1$; i.e., just below the upper part of shaft 3 very close to the lower face of mold A and casting impression 10.

The wire submersion level H in shaft 3, below level N, corresponds to the amount of wire that must be dissolved in pig M for thorough inoculation. If the quantity of inoculant at height H is insufficient, wire 13 can be further unrolled from spool 14 until the amount of wire dissolved in liquid metal M is sufficient.

Figure 11:
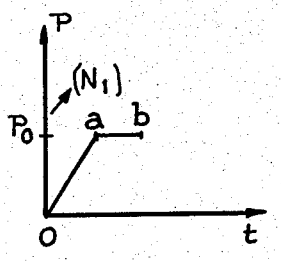

At this stage the process is at point a of the pressure/-time diagram in FIG. 11, after achieving the rise Oa to reach the pre-pressure PO corresponding to level $N_1$. This pre-pressure is maintained for a period corresponding to the level segment ab of FIG. 11 until the submerged wire length H is completely dissolved. The inoculation time corresponding to level ab is not more than a few seconds (2 to 3 on the average); this time can be regulated.

Figure 7:
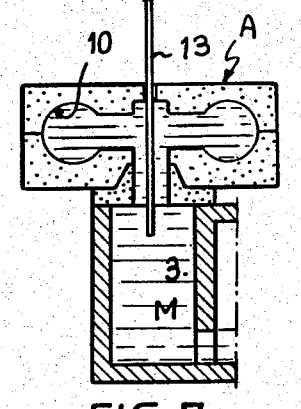
Figure 12:
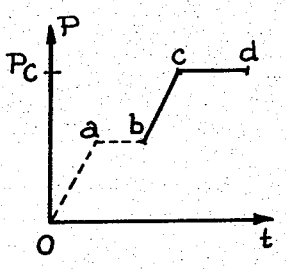

(4) Casting (FIGS. 7 and 12):

The gas pressure in chamber 2 is raised to the casting pressure PC; from b to c in FIG. 12. This causes the liquid Pig M to rise inside casting impression 10 (FIG. 7) until it is completely filled. When the pig goes from shaft 3 to the hollow of casting impression 10, it is mixed with the inoculant just dissolved, which perfects the uniformity of inoculation.

The casting pressure PC is maintained in ladle 1 long enough to allow solidification of the pig inside casting impression 10, corresponding to segment cd in FIG. 12.

Figure 8:
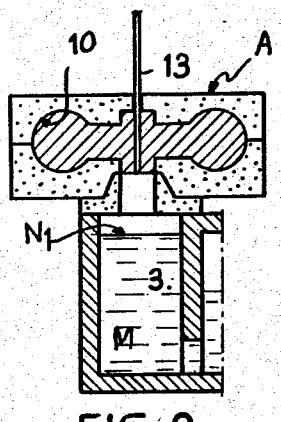

(5) Solidification of the cast piece and pressure drop back to level $N_1$ (FIGS. 8 and 13):

Upon completion of the solidification time for the cast piece inside mold A (a time known from experience), the gas pressure in chamber 2 is lowered from the casting pressure PC to a pre-pressure level Po1, slightly above the pre-pressure PO in FIG. 11.

Figure 13:
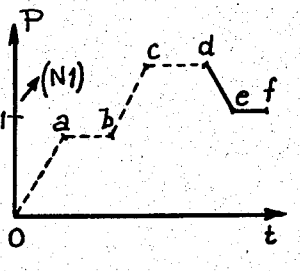

The level of the pig is thus returned to $N_1$ in uphill shaft 3, despite the drop in the level in chamber 2, not shown, due to the consumption of a certain amount of pig inside casting impression 10. This consumption necessitates a pre-pressure Po1 higher than pre-pressure PO. In FIG. 13 this pressure drop corresponds to the descending segment de, which is followed by a level segment ef at pressure Po1 during the opening or removal of the mold just cast and the bringing in of a new mold to fill. This completes the cycle of pressure/time variations O a b c e d f.

When the pig has solidified inside the mold and after the excess liquid pig in shaft 3 has fallen back, the inoculation wire 13 is partly melted and/or partly submerged in a solid state in the solidified piece. Either way, when mold A is removed wire 13 can be cut off level with the upper surface of the mold, whereafter the cast piece is stripped of any remaining wire which may be sticking out, which can also be cut off level.

Result of inoculation (FIGS. 21 and 22)

A micrograph of the cast and inoculated piece (FIG. 22) reveals the presence of graphite nodules extremely regularly distributed. This proves that the graphitization is uniform due to complete inoculation in casting shaft 3 (FIGS. 6 and 11) resulting from introducing the pig very shortly after inoculation (FIGS. 7 and 12) without risking a loss of this brief inoculation effect in the liquid pig and from a mixture of the pig and dissolved inoculant when the pig enters impression 10. In this ferrite structure there is a high density of graphite nodules of regular size, which imparts a considerable uniformity to the cast piece structure.

By comparison, FIG. 21 shows a micrograph of a spheroidal graphite piece cast by the same low pressure technique but inoculated by a known procedure, such as introducing the inoculant as a ferrosilicon powder inside the casting impression. The graphite nodules in this structure are less than 10% perlite, but their distribution and size are much more irregular than in FIG. 22 due to nonuniform mixture of the liquid pig and inoculant powder inside casting impression 10, and the absence of mixture and regular distribution of this powder inside the impression. The micrographs in FIGS. 21 and 22 correspond to zones of equal thickness greater than 5 mm.

The FIG. 22 structure also has a low proportion of perlite, less than 10%. In the case (not that of FIGS. 21 and 22) where the cooling conditions of the cast piece would result in a perlite structure in the raw casting state, whereas the previously known inoculation technique would have no effect on this tendency, the inoculation method of the invention enables a reduction in the percentage of perlite obtained in the raw casting state.

Variations

In the inoculation phase, where the amount of inoculant already dissolved is insufficient, before casting impression is filled an additional length of wire 13 can be lowered into the liquid pig column in shaft 3 for dissolution.

Figure 15:
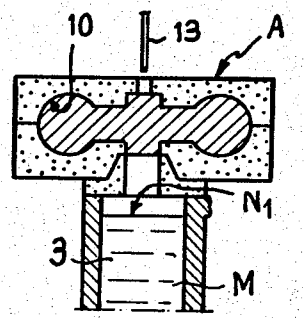
Figure 14:
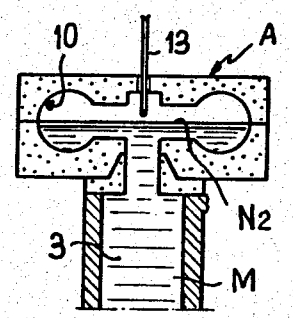
Figure 17:
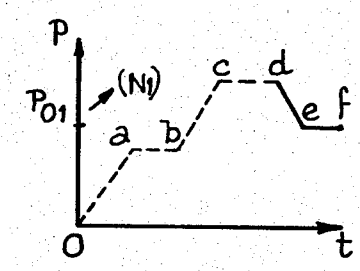
FIGS. 16 and 17 are time plots corresponding to FIGS. 14 and 15 for various pressures in the casting ladle.
Figure 16:
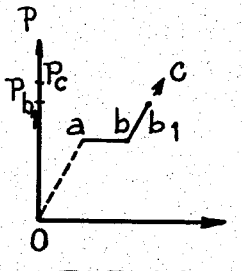

After inoculation, instead of leaving wire 13 immobile in the mold so that it is submerged in the pig filling the casting hollow 10 (FIGS. 7 and 8), the wire 13 can be withdrawn as the liquid pig rises and solidifies (FIGS. 14 and 15). According to FIGS. 14 and 16, the wire 13 is withdrawn as the pig rises in hollow 10, keeping the lower end of the wire out of the liquid pig. The level $N_2$ shown corresponds to a point b1 of pressure Pb1 in the pressure diagram (FIG. 16) of chamber 2. After the pig has solidified (FIGS. 15 and 17) the wire is just outside of the mold, ready to be reintroduced for the next inoculation. The level $N_1$ is dropped back to just below mold A under pressure POI (FIG. 17 is the same as FIG. 13), but the wire is not submerged in the cast piece and does not need to be cut off, which saves time.

As another variation, wire 13 can be withdrawn from mold A even before the filling of the mold begins.

Figure 18:
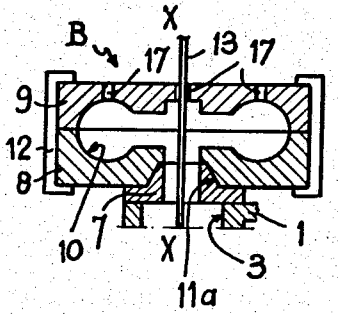
FIG. 18 is a sectional view similar to FIG. 2 showing the application of the invention to a mold equipped with risers.
Figure 19:
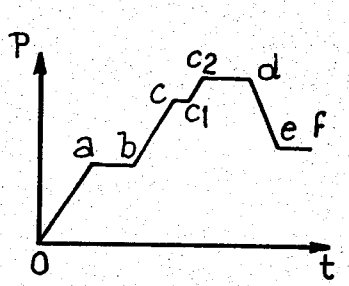
FIG. 19 is a time plot of pressure variations in the casting ladle corresponding to FIG. 18.

Riser mold (FIGS. 18 and 19)

If mold B contains risers 17 through its upper part 9 connecting hollow 10 with the atmosphere, and notably a riser 17 in the XX axis of the liquid pig charge hole 11*a*, the wire 13 is easily fed through the mold via the riser. The pressure is then raised in the following fashion in the casting ladle after inoculation, to fill hollow 10 (FIG. 19):

Point b in FIG. 19 represents the pressure and time situation after inoculation and just before mold B is filled. Ascending segment bc shows the pressure rise in chamber 2 to introduce the liquid pig into hollow 10 until it reaches the upper face of the mold. Level segment cc1 shows the maintenance of this pressure until the pig solidifies in risers 17, which transforms mold B into a closed one. This solidification takes place quickly; segment cc1 is thus quite short.

The ascending segment cl–c2 shows a rise in pressure in chamber 2 to bring an extra amount of hot pig into the casting hollow, thus compensating for the withdrawal and possible shrinkage in the risers. The remainder of FIG. 19 is identical to FIG. 13.

Figure 20:
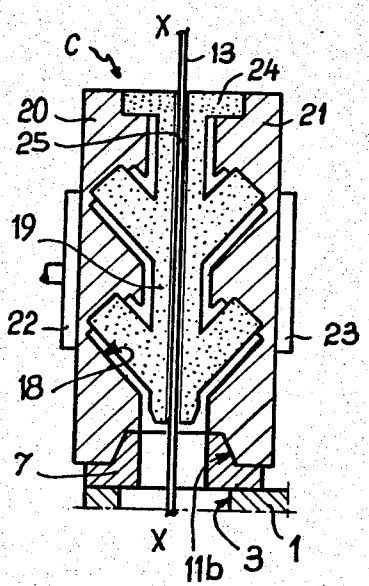
FIG. 20 is a sectional view showing the application of the invention to a vertical joint mold with a core.

Vertical core mold (FIG. 20)

Finally, FIG. 20 shows the application of the invention to a vertical joint mold C symmetrical about axis XX defining a casting hollow 18 and having a sand core 19. The mold, such as that of an engine manifold, is in two parts 20 and 21 urged against each other by two pressure plates 22 and 23. Core 19 can be suspended in casting hollow 18 by an upper bearing 24.

As in the preceding examples, mold C has an axial casting hole 11*b* on its lower face, which mates with nozzle 7 of casting ladle 1.

Inoculation wire 13 runs through the core 19 along axial passage 25 and into casting shaft 3. As before, the useful length of the wire for the inoculation is not the part going through the mold, but the part below submerged in the pig M in the shaft before the pig is introduced into the annular casting hollow 18.

Inoculation and filling of the mold occur as previously. Wire 13 can be allowed to set in the solidified pig, at least in the lower part of the mold, or be withdrawn as the pig rises in the mold, or withdrawn even before the filling of the mold begins.

The advantages of the invention include the following:

(a) The insertion of a length H of inoculation wire into uphill casting shaft 3 for a period of time represented by pre-pressure segment ab (FIGS. 6 and 11) yields total dissolution of the inoculant in the pig M before it is introduced into the mold.

(b) The mixture of the pig and dissolved inoculant during the movement of the pig up the shaft 3 and into the casting hollow ensures excellent inoculant uniformity in the pig mass.

(c) Unwinding inoculation wire 13 from a reeling machine 14 enables the continued lowering of the wire into shaft 3 as it melts, when wire segment H is insufficient to inoculate all of the pig mass being introduced into the mold. The amount of inoculant used can thus be precisely controlled.

(d) Inoculation of pig M during the pre-pressure phase Oab (FIGS. 6 and 11); i.e., in shaft 3, before the mold is charged allows the inoculation time to be closely controlled. This time begins when wire 13 is submerged, and ends when complete dissolution of the wire in the pig is verified.

(e) Submersion of wire 13 in shaft 3 of constant cylindrical cross-section, whatever the shape and volume of the mold cavity, ensures constant inoculation per unit volume and invariable and repetitive inoculation quality.

(f) This inoculation method, combined with a low pressure uphill casting, enables the pig to be rapidly introduced into the mold cavity after the inoculation and without a sizeable path or distance to be covered, so that the inoculation effect of the liquid pig, known to be brief, is not lost.

(g) Inoculation according to the invention also enables a reduction in the perlite proportion in the cast structure, which is advantageous for making automobile engine manifolds.

(h) The method and apparatus enable fabrication of large cast pieces at high speed, with minimal inoculation time. Indeed, the inoculation time corresponding to pre-pressure branch Oab in FIG. 11 is that of the fusion of a certain length of inoculant wire 13, with the mold already in place and in close contact with casting nozzle 7. The method is based on inoculating only the liquid pig mass in shaft 3 to be introduced into the mold. It is thus applicable to cast pieces weighing several kilograms, for example exhaust manifolds of automobile engines.

(i) This inoculation and casting method make it possible to uniformly inoculate both thin and complex pieces to ensure perfect uniformity of graphitization, since the manner of inoculation is independent of the shape of the cast piece and the rate at which the mold is charged with liquid metal.

If inoculation wire 13 is not continuously fed from a spool or reeling machine 14, or if the mold does not have a wire feed hole, the wire can be suspended from the ceiling of the mold cavity by a hook and ring arrangement; these are submerged in the casting after the pig solidifies. Of course, in this instance the inoculation wire must extend well under the lower face of mold A in order to be submerged in uphill casting shaft 3 as shown in FIG. 1.

Of course, a wire thus suspended can also be used with a closed sand mold. The only difference from the metal mold is that the upper end of the wire can be fastened and held on the outer upper face of the mold, after penetrating through the ceiling of the mold.

What is claimed is:

1. A method for inoculating liquid metal (M) in a low pressure, uphill casting apparatus including a casting ladle (1), means (5) for applying gas pressure to the ladle, a vertical casting shaft (3) in communication with the ladle for receiving liquid metal therefrom, and a mold (A) disposed above the ladle, tightly mounted to an upper end of the shaft, and defining an interior cavity

(10) having a lower charging hole (11) in communication with a nozzle (7) of the shaft, comprising the steps of:

(a) suspending a soluble inoculation wire (13) downwardly through the cavity and axially into the shaft such that a lower end of the wire lies just above a first level (N) of liquid metal in the shaft, (b) raising the gas pressure in the ladle to attendantly raise the liquid metal in the shaft to a second level ($N_1$) at which a predetermined length (H) of the wire is submerged, (c) maintaining the gas pressure and the second level for a predetermined time (ab) sufficient to dissolve substantially all of the submerged wire, and (d) immediately thereafter, further raising the gas pressure in the ladle to attendantly force the thus inoculated liquid metal in the shaft up through the nozzle and charging hole and into the mold cavity to fill said cavity.

2. A method according to claim 1, wherein the wire is suspended through a passage hole (9*a*) in a ceiling of the mold axially aligned with the shaft axis (XX).

3. A method according to claim 1, wherein after the predetermined length of wire has dissolved in the liquid metal in the shaft, and before the mold cavity is filled, an additional length of wire is introduced into the shaft and submerged in the liquid metal.

4. A method according to claim 1, wherein the wire (13) is fastened to an upper interior ceiling portion of the mold cavity.

5. A method according to claim 1, wherein the mold is a sand mold, and the wire passes through an upper surface of the mold into and through the cavity.

6. A method according to claim 1, wherein between steps (c) and (d), the wire is retracted upwardly through the shaft and cavity to prevent further immersion as the inoculated metal rises.

7. A method according to claim 1, wherein concurrently with step (d), the wire is withdrawn upwardly through the shaft and cavity to prevent further inoculation of the rising metal.

* * * * *